US009559418B2

(12) United States Patent
Iso et al.

(10) Patent No.: US 9,559,418 B2
(45) Date of Patent: Jan. 31, 2017

(54) PHASE SHIFTER HAVING DIELECTRIC MEMBERS INSERTED INTO A MOVABLE SUPPORT FRAME

(71) Applicant: Hitachi Metals, Ltd., Tokyo (JP)

(72) Inventors: Naoki Iso, Hitachi (JP); Yoshiaki Ishigami, Hitachi (JP); Masahisa Kaneta, Hitachi (JP); Nobuaki Kitano, Hitachi (JP); Tomoyuki Ogawa, Hitachi (JP); Tsukasa Fujishima, Tokai-mura (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/711,990

(22) Filed: May 14, 2015

(65) Prior Publication Data

US 2016/0013532 A1 Jan. 14, 2016

(30) Foreign Application Priority Data

Jul. 14, 2014 (JP) ..... 2014-144156

(51) Int. Cl.
*H01Q 3/32* (2006.01)
*H01P 1/18* (2006.01)

(52) U.S. Cl.
CPC ..... *H01Q 3/32* (2013.01); *H01P 1/184* (2013.01); *H01P 1/181* (2013.01)

(58) Field of Classification Search
CPC ..... H01P 1/18; H01P 1/184; H01P 9/00; H01P 9/0006; H01Q 3/32
USPC ..... 333/161
See application file for complete search history.

(56) References Cited

U.S. PATENT DOCUMENTS 3,440,573 A * 4/1969 Butler ..... H01P 1/183 333/156
5,905,462 A * 5/1999 Hampel et al. ..... H01Q 3/26 333/159
2014/0232484 A1* 8/2014 Sakasai et al. ..... H01P 1/184 333/161

FOREIGN PATENT DOCUMENTS

JP 11-340705 A 12/1999

* cited by examiner

*Primary Examiner* — Benny Lee
(74) *Attorney, Agent, or Firm* — McGinn IP Law Group, PLLC.

(57) ABSTRACT

A phase shifter includes dielectric members including facing portions facing a signal line formed on a surface of a substrate and being made of a dielectric material, a supporting member configured to support the dielectric members and receive a moving force for moving the dielectric members in a direction which is parallel to the substrate and crosses the signal line, and a moving mechanism configured to apply the moving force to the supporting member. At least either the dielectric members or the supporting member is provided with a protrusion configured to keep a distance between the facing portions of the dielectric members and the signal line.

18 Claims, 10 Drawing Sheets

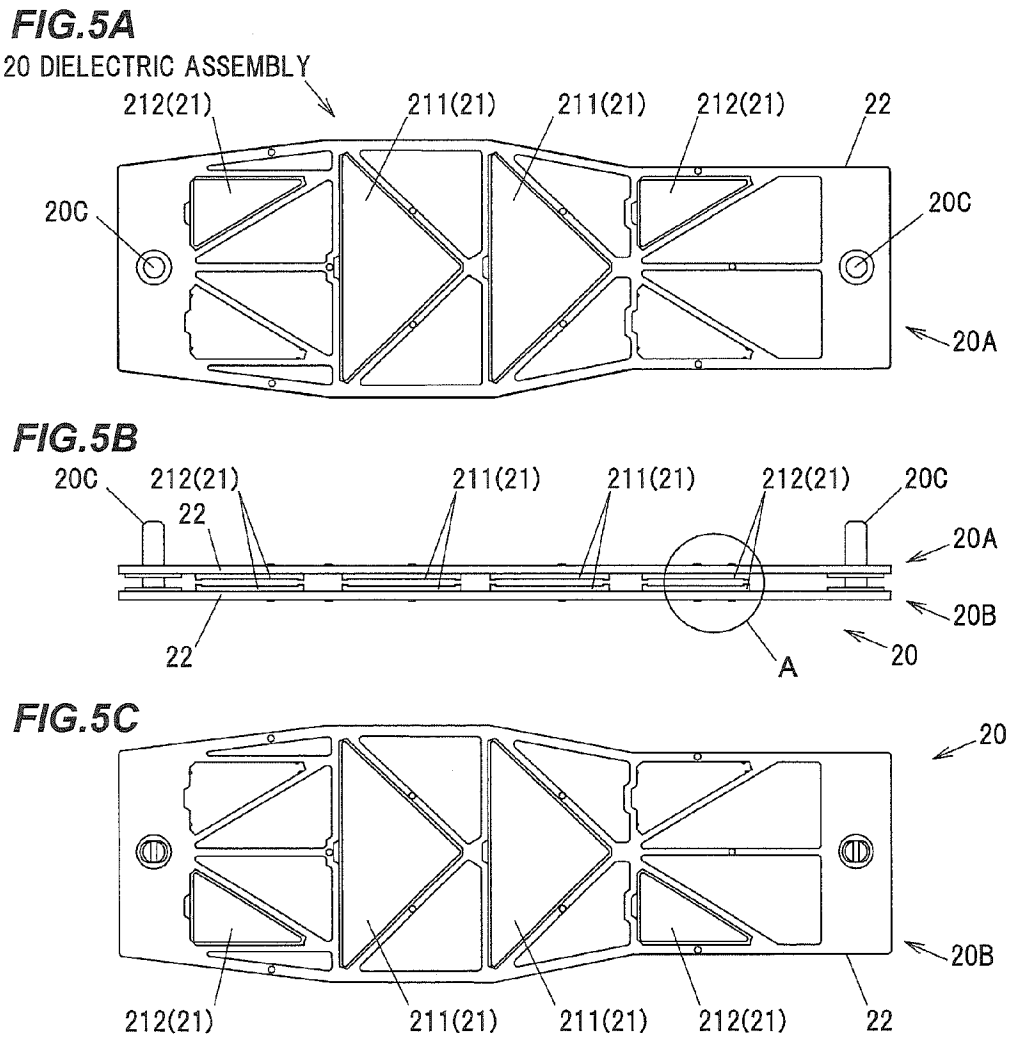
FIG.5A
FIG.5B
FIG.5C
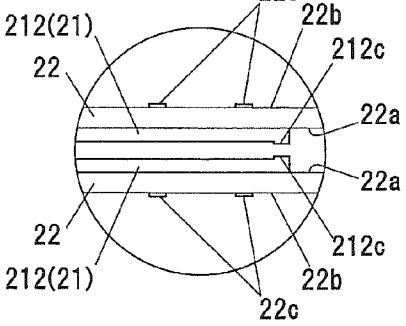
FIG.5D

22 SUPPORTING MEMBER
221 FIRST SUPPORTING FRAME
222 SECOND SUPPORTING FRAME
223 THIRD SUPPORTING FRAME
224 FOURTH SUPPORTING FRAME
22b
22c
225
B 22
22a
220
223
222

221
224

220a
220b

PHASE SHIFTER HAVING DIELECTRIC MEMBERS INSERTED INTO A MOVABLE SUPPORT FRAME

The present application is based on Japanese patent application No. 2014-144156 filed on Jul. 14, 2014, the entire contents of which are incorporated herein by reference.

BACKGROUND OF THE INVENTION

1. Field of the Invention

This invention relates to a phase shifter, which is capable of changing a signal phase, and an antenna device equipped with that phase shifter.

2. Description of the Related Art

Conventionally, a phase shifter that is provided in a triplate line including a pair of outer conductors and an inner conductor arranged therebetween and is capable of changing a phase of a signal propagating in the inner conductor has been known (Refer to e.g. JP-A-11-340705).

The phase shifter disclosed in JP-A-11-340705 includes a plate-shaped dielectric coupled to a driving rod to be moved forward or backward. The forward or backward movement of the driving rod results in the dielectric moving in a direction of crossing the inner conductor, and varying the proportion that the dielectric occupies in the spaces between the inner conductor and the pair of outer conductors respectively. Thus, a variation in effective permittivity of the triplate line occurs, resulting in a variation in electrical line length and therefore a variation in the phase of the signal propagating in the inner conductor (e.g., as shown in FIG. 4 of JP-A-11-340705).

Refer to e.g. JP-A-11-340705 (paragraph, FIG. 4).

SUMMARY OF THE INVENTION

However, due to the movement of the dielectric resulting from the forward or backward movement of the driving rod, the variation in the effective permittivity of that triplate line is caused by movement of the dielectric in the thickness direction of the inner conductor. That is, with the dielectric at least partially inserted in the spaces between the inner conductor and the pair of outer conductors respectively, the variation in the phase of the signal is caused by the dielectric moving closer to or away from the inner conductor resulting from vibration, etc. In other words, the amount of phase shift is unstable.

Accordingly, it is an object of the present invention to provide a phase shifter, capable of providing a stable amount of phase shift.

(1) According to one embodiment of the invention, a phase shifter comprises:

dielectric members including facing portions facing a signal line formed on a surface of a substrate and comprising a dielectric material;

a supporting member configured to support the dielectric members and receive a moving force for moving the dielectric members in a direction which is parallel to the substrate and crosses the signal line; and a moving mechanism configured to apply the moving force to the supporting member, wherein the dielectric members or the supporting member is provided with a protrusion configured to keep a distance between the facing portions of the dielectric members and the signal line.

In one embodiment, the following modifications and changes may be made.

(i) The dielectric members are arranged between the substrate and conductor plates respectively arranged parallel to the substrate, and the dielectric members or the supporting member is provided with a protrusion configured to keep a distance between the facing portions of the dielectric members and the conductor plates.

(ii) The protrusion configured to keep the distance between the facing portions of the dielectric members and the signal line is formed on the dielectric members.

(iii) The signal line is formed on both main surfaces of the substrate, and assemblies each comprising the dielectric members assembled to the supporting member are arranged on one main surface side of the substrate and an other main surface side of the substrate respectively, and the assembly arranged on the one main surface side and the assembly arranged on the other main surface side are coupled together via a coupling member inserted in an inserting hole formed through the substrate.

(2) According to another embodiment of the invention, an antenna device comprises:

the phase shifter according to (1); and antenna elements, wherein a signal phase difference between the antenna elements is adjusted by the phase shifter.

(Points of the Invention)

The phase shifter in the present invention and the antenna device equipped with that phase shifter can provide a stable amount of phase shift.

BRIEF DESCRIPTION OF THE DRAWINGS

The preferred embodiment according to the invention will be explained below referring to the drawings, where like features in different drawing figures are denoted by the same reference numbers and wherein:

FIGS. 2A and 2B are perspective views showing a specific configuration example of the antenna device, wherein FIG. 2A shows an appearance of the antenna device, and FIG. 2B shows a plurality of antenna elements arranged in the antenna device;

FIG. 5A is a front view showing a dielectric assembly;

FIG. 5B is a side view showing the dielectric assembly;

FIG. 5C is a back view showing the dielectric assembly;

FIG. 5D is a partially enlarged view in FIG. 5B;

DETAILED DESCRIPTION OF THE PREFERRED EMBODIMENT (Embodiment)

Below is described an embodiment for a phase shifter and an antenna device 1 (FIG. 1) according to the present invention, with reference to FIGS. 1 to 10. This antenna device 1 is used as a mobile phone base station antenna. It should be noted that in the following description the antenna device 1 in this embodiment is described as being used for high frequency signal transmission, but this antenna device 1 may be used for high frequency signal reception as well.

(Function and Configuration of the Antenna Device)

Figure 1:
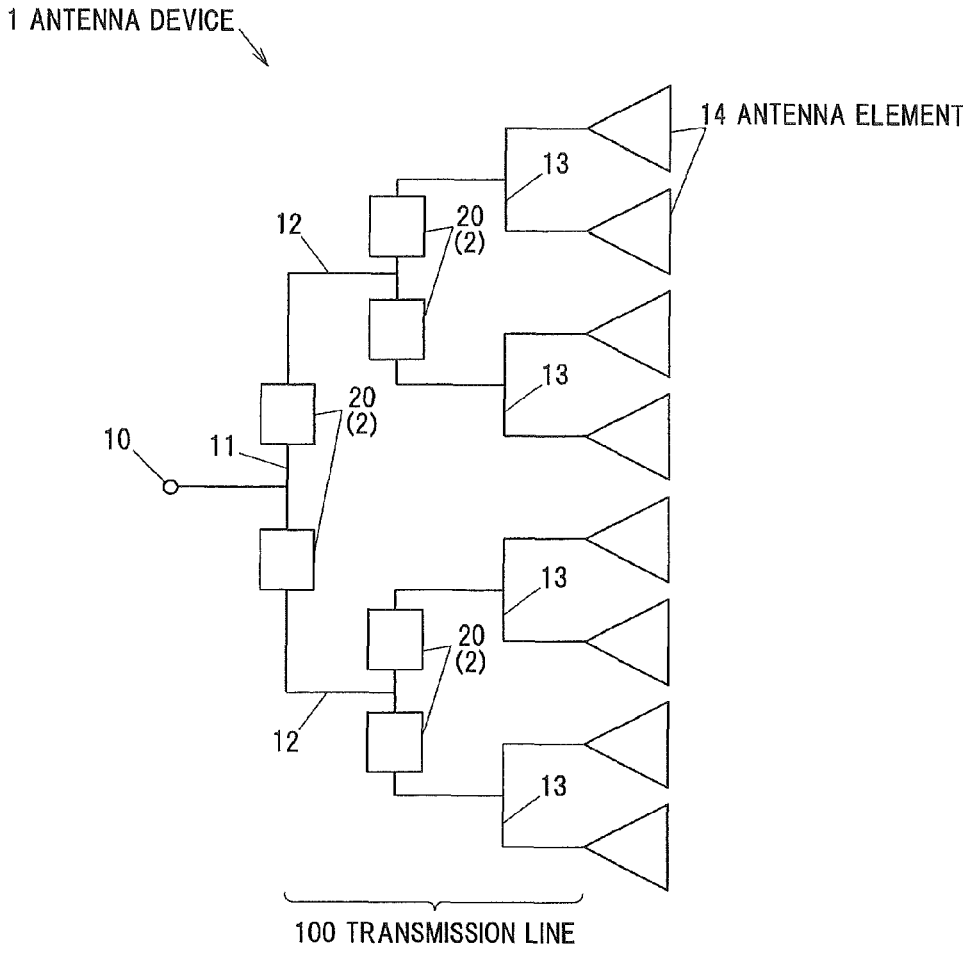
FIG. 1 is a schematic diagram showing a function and configuration of an antenna device in an embodiment according to the invention.

FIG. 1 is a schematic diagram showing a function and configuration of the antenna device 1 in the present embodiment. This antenna device 1 can transmit horizontal polarized and vertical polarized high frequency signals in a band of e.g. 1.5 to 2 GHz.

The antenna device 1 includes a plurality (in the present embodiment, eight) of antenna elements 14, and a transmission line 100 for transmitting a signal, which is input to an input 10 for a coaxial cable (not shown) connected thereto, to the plurality of antenna elements 14. The transmission line 100 comprises a first distribution line 11, which distributes the signal input to the input 10, the second distribution lines 12, which further distribute the signals respectively distributed by the first distribution line 11, and third distribution lines 13, which further distribute the signals respectively distributed by the second distribution lines 12.

Also, between the first distribution line 11 and the second distribution lines 12, and between the second distribution lines 12 and the third distribution lines 13, there are arranged dielectric assemblies 20 for phase shifters 2, respectively, to be described later. Phases of the signals are changed by these phase shifters 2 including the dielectric assemblies 20, so that phase differences between radio signals radiated from the plurality of antenna elements 14 are adjusted.

(Configuration of the Antenna Device)

Figure 2A:
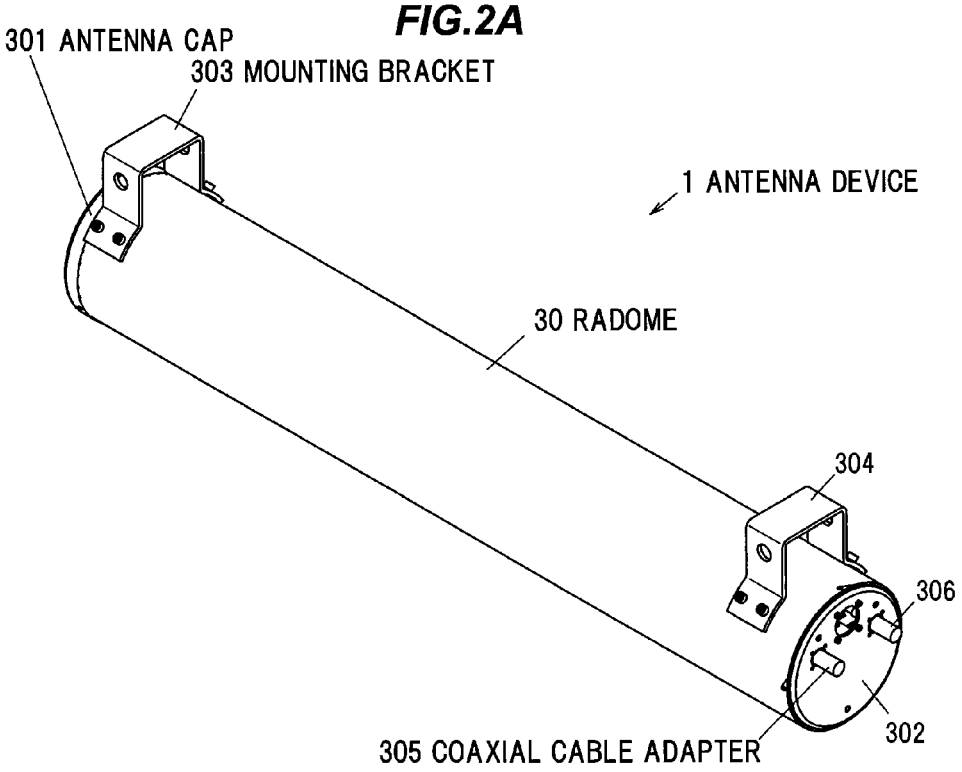
Figure 2B:
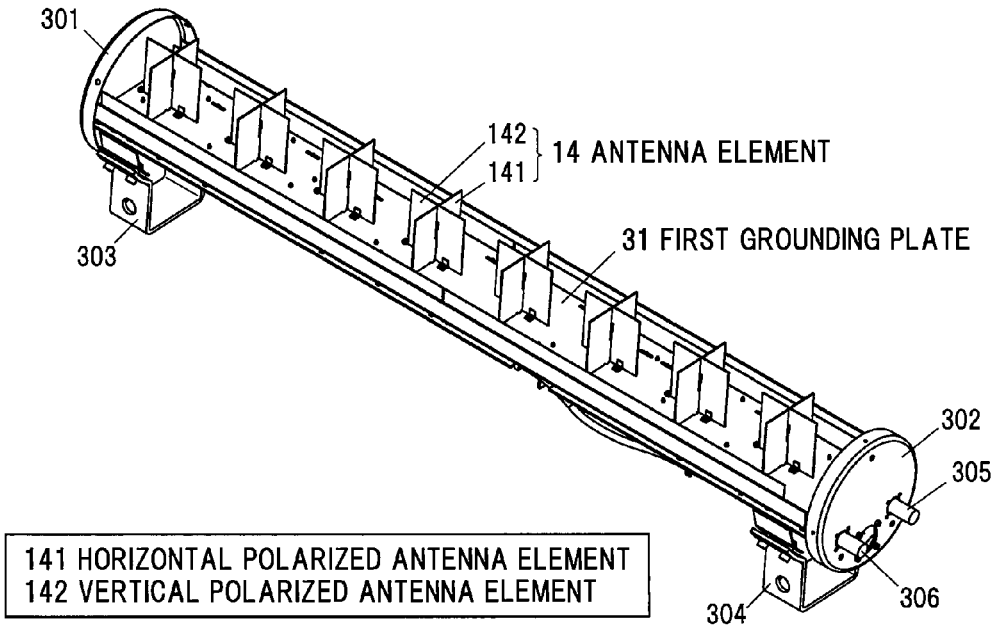
Figure 3:
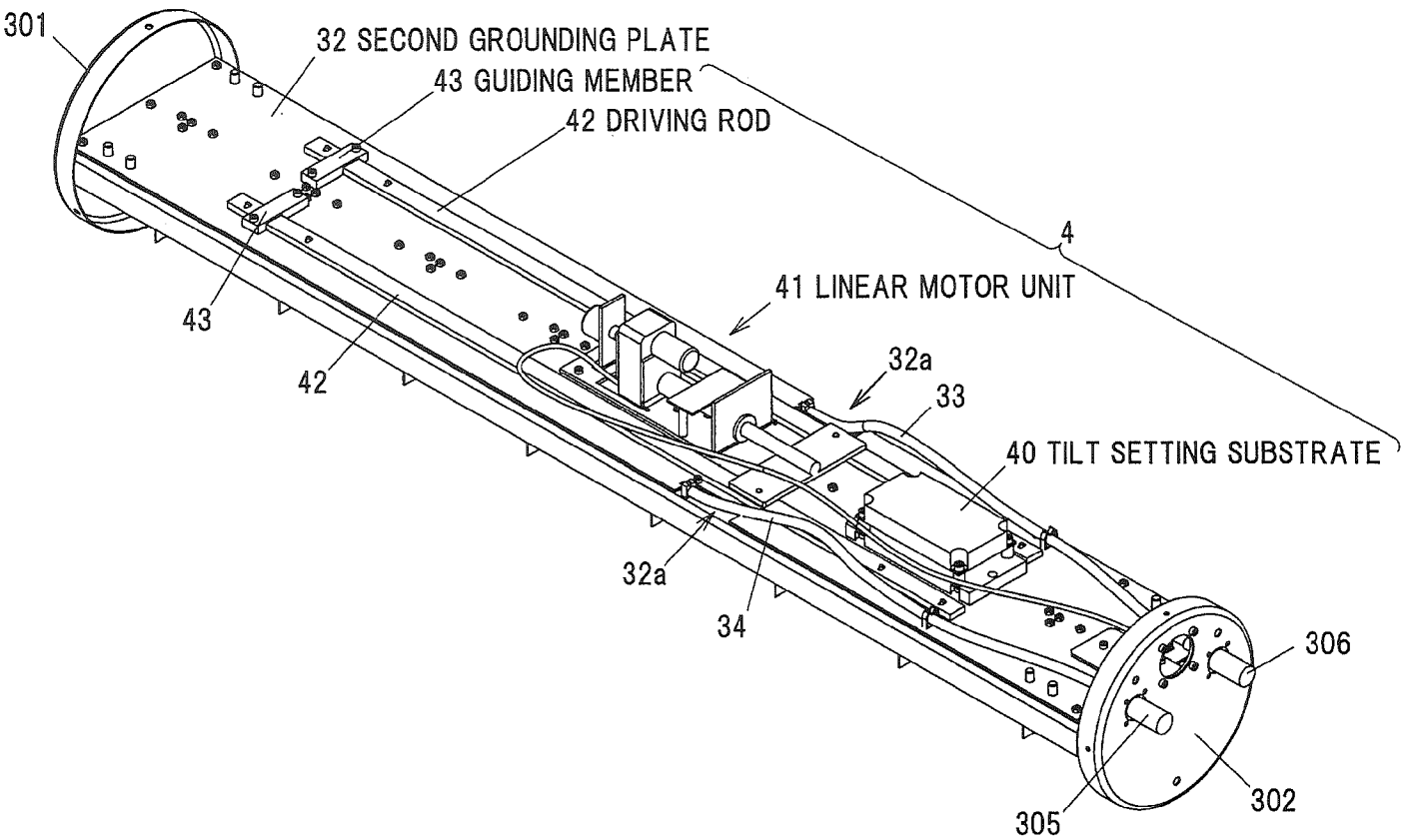
FIG. 3 is a perspective view showing a configuration example of a moving mechanism arranged inside a radome and on the opposite side to the plurality of antenna elements.

Next, referring to FIGS. 2A, 2B, and 3, a specific configuration example of the antenna device 1 (FIG. 2A) is described.

FIGS. 2A and 2B are perspective views showing a specific configuration example of the antenna device 1, wherein FIG. 2A shows an appearance of the antenna device 1, and FIG. 2B shows the plurality of antenna elements 14 arranged in the antenna device 1. As shown in FIG. 2A, the antenna device 1 is configured to receive (accommodate) the transmission line 100 of FIG. 1, the plurality of antenna elements 14 of FIG. 1 and the like in a cylindrical radome 30.

The radome 30 is closed by antenna caps 301 and 302 at both ends, and is mounted at a high altitude of an antenna tower or the like with mounting brackets 303 and 304 in such a manner that its center axis direction is a vertical direction. The antenna cap 302 arranged on the lower side in the vertical direction is mounted with coaxial cable adapters 305 and 306 which act as the input 10 (FIG. 1).

As shown in FIG. 2B, the plurality of antenna elements 14 are aligned in the longitudinal direction of the radome 30 (FIG. 2A), and fixed to a first ground plate 31 being electrically grounded. Each of the antenna elements 14 includes a horizontal polarized antenna element 141 and a vertical polarized antenna element 142 which are arranged in a shape of a cross. The first ground plate 31 acts as a reflector for reflecting electromagnetic waves radiated from the horizontal polarized antenna elements 141 and the vertical polarized antenna elements 142.

The horizontal polarized antenna elements 141 and the vertical polarized antenna elements 142 are printed dipole antennas made of a printed circuit board with a wiring pattern (not shown) formed on a dielectric plate to act as a radiating element. The horizontal polarized antenna elements 141 and the vertical polarized antenna elements 142 are provided with protruding portions (not shown) respectively to be inserted in openings respectively formed through the first ground plate 31, so that the wiring patterns configured to act as the radiating elements are electrically connected via these protruding portions to terminals of the third distribution lines 13 (FIG. 1) respectively of the transmission line 100.

With reference to FIG. 1, a line length in each part of the transmission line 100 is adjusted in such a manner that the more lagging phase signal is provided to the lower side arranged antenna element 14 of the plurality of antenna elements 14. As a result, the directivity (beam tilt angle) of radio waves radiated from the antenna device 1 is oriented downwardly relative to the horizontal direction. Also, it is possible to set the beam tilt angle at a desired value by adjusting a signal phase difference provided to each antenna element 14 by the plurality of phase shifters 2.

FIG. 3 is a perspective view showing a configuration example of a moving mechanism 4 of the phase shifter 2 arranged inside the radome 30 and on the opposite side to the plurality of antenna elements 14. This moving mechanism 4 is provided on a second ground plate 32 which is arranged parallel to the first ground plate 31 (FIG. 2B) with the plurality of antenna elements 14 fixed thereto. The first ground plate 31 and the second ground plate 32 are made from an electrically conductive metal such as stainless steel or the like, and electrically grounded. Also, each of the first ground plate 31 and the second ground plate 32 is formed in an elongated plate shape a longitudinal direction of which is along the center axis direction of the radome 30.

The moving mechanism 4 is configured to move a supporting member 22 (FIGS. 5A to 5C and 6A to 6C) of the phase shifter 2 to be described later in the longitudinal direction of the first ground plate 31 and the second ground plate 32, and includes a linear motor unit 41, a pair of driving rods 42, which are moved in the longitudinal direction of the first ground plate 31 and the second ground plate 32 by driving force of the linear motor unit 41, and a pair of guiding members 43, which guide the movement of the pair of driving rods 42. Also, on the second ground plate 32, there is arranged a controller, which controls the linear motor unit 41 by receiving an external command signal.

At both ends in the transverse direction of the second ground plate 32, there are formed notches 32*a*, respectively, therethrough so that the horizontal polarized coaxial cable 33 and the vertical polarized coaxial cable 34 are inserted in these notches 32*a* at their respective one ends, respectively. The transmitted signal is provided via the horizontal polarized coaxial cable 33 and the vertical polarized coaxial cable 34 to the first distribution line 11 (FIG. 1) of the transmission line 100. The horizontal polarized coaxial cable 33 and the vertical polarized coaxial cable 34 are connected to the coaxial cable adapters 305 and 306 at their respective other ends, respectively.

Figure 4:
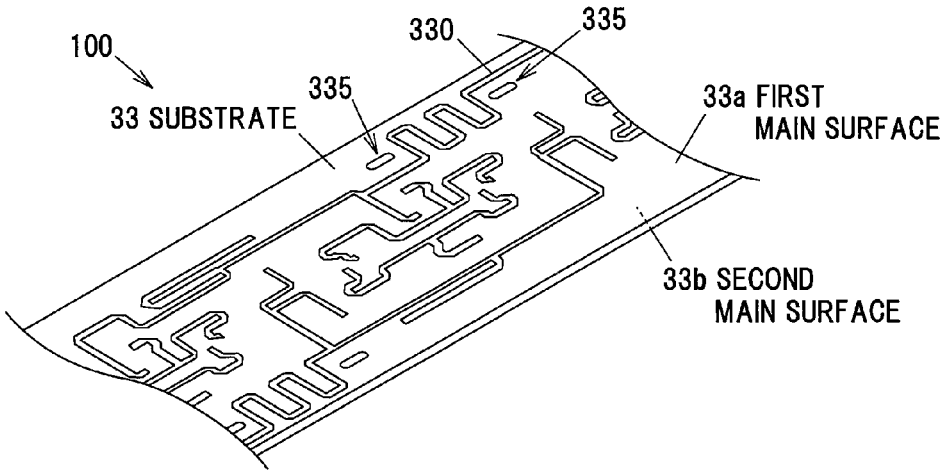
FIG. 4 is a perspective view showing a substrate, which is arranged between a first ground plate and a second ground plate, and a signal line, which is formed on a surface of that substrate.

FIG. 4 is a perspective view showing a substrate 33, which is arranged between the first ground plate 31 and the second ground plate 32 (FIG. 2B), and a signal line 330, which is formed on a surface of that substrate 33. The substrate 33 is made of an electrically insulative resin (dielectric) such as glass epoxy or the like, and is arranged parallel to the first ground plate 31 and the second ground plate 32. Also, the substrate 33 is in a rectangular shape having long sides in the longitudinal direction of the first ground plate 31 and the second ground plate 32. In FIG. 4, the substrate 33 is illustrated partially in the longitudinal direction.

The signal line 330 is formed of a metal foil such as copper foil or the like provided as a wiring pattern on the surface of the substrate 33. Also, the signal line 330 is formed symmetrically on both surfaces (referred to as first main surface 33*a* and second main surface 33*b*) of the substrate 33. That is, for example, when the substrate 33 is viewed from the first main surface 33*a* side, the signal line 330 formed on the first main surface 33*a* is identical in shape to the signal line 330 formed on the second main surface 33*b*, i.e. the back side of the substrate 33. This signal line 330 constitutes the first to third distribution lines 11 to 13 (FIG. 1) of the transmission line 100.

The first ground plate 31, the second ground plate 32, and the signal line 330 constitute a triplate line. The space between the first ground plate 31 and the second ground plate 32 is e.g. 5.0 mm. Also, the total thickness of the substrate 33 and the signal line 330 on both the surfaces of the substrate 33 is e.g. 0.8 mm, and the thickness of the signal line 330 on one surface of the substrate 33 is e.g. 0.035 mm.

(Configuration and Operation of the Phase Shifter)

Next, referring to FIGS. 5A to 10B, a configuration of the phase shifter 2 and operation thereof are described.

FIG. 5A is a front view showing a dielectric assembly 20, FIG. 5B is a side view showing the dielectric assembly 20, FIG. 5C is a back view showing the dielectric assembly 20, and FIG. 5D is an enlarged view showing a portion A in FIG. 5B.

Figures 6A, 6B, 6C, 6D, 6E:
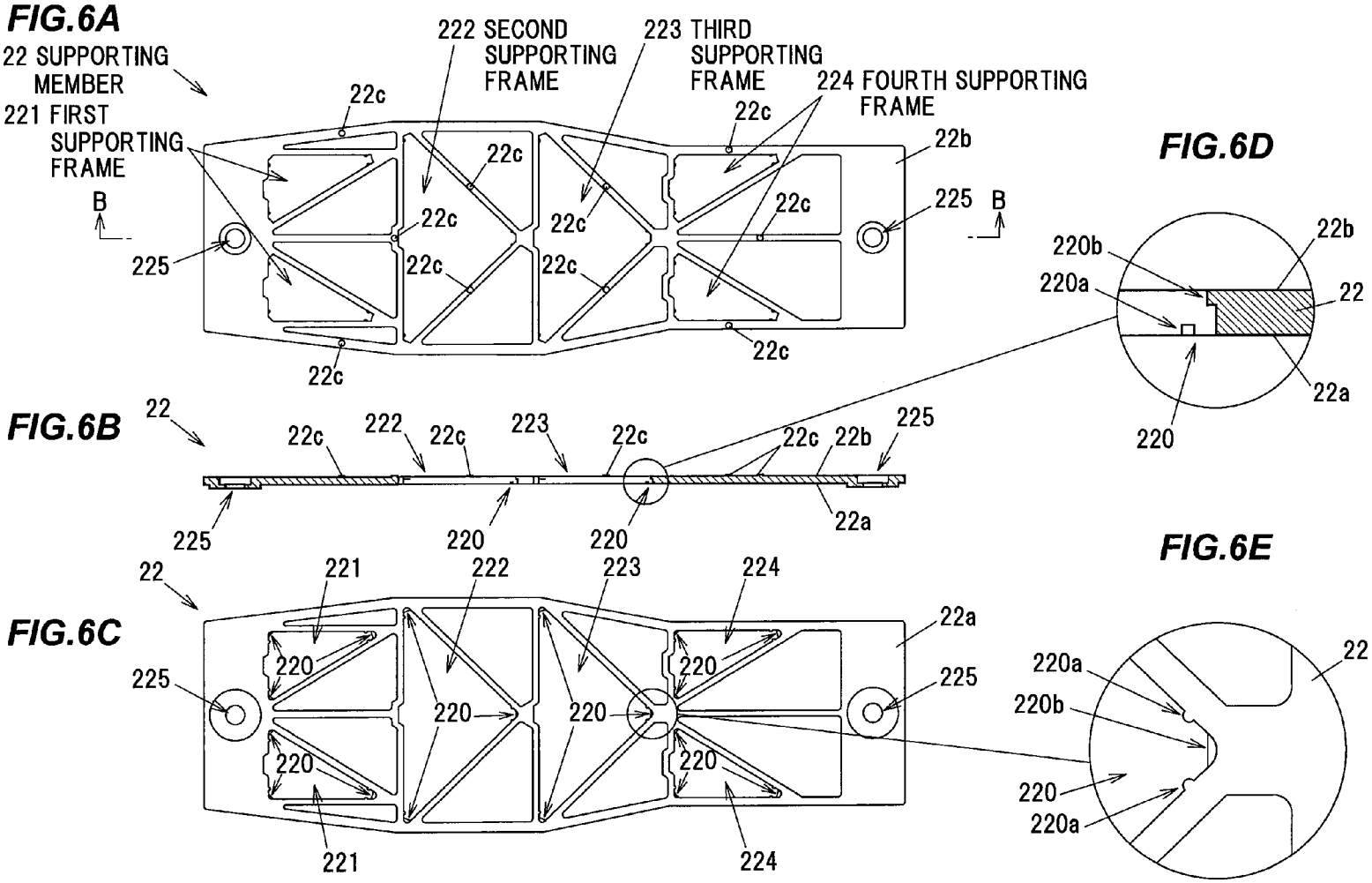
FIG. 6A is a front view showing a supporting member of the dielectric assembly.
FIG. 6B is a cross sectional view along B-B line in FIG. 6A showing the supporting member.
FIG. 6C is a back view showing the supporting member.
FIG. 6D is a partially enlarged view in FIG. 6B.
FIG. 6E is a partially enlarged view in FIG. 6C.

FIG. 6A is a front view showing a supporting member 22 of the dielectric assembly 20, FIG. 6B is a cross sectional view along B-B line in FIG. 6A showing the supporting member 22, FIG. 6C is a back view showing the supporting member 22, and FIG. 6D is a partially enlarged view in FIG. 6B, and FIG. 6E is a partially enlarged view in FIG. 6C.

Figure 7A:
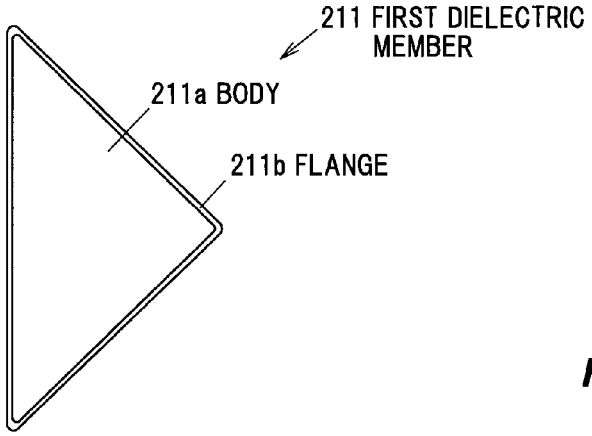
FIG. 7A is a front view showing a first dielectric member.
Figure 7B:
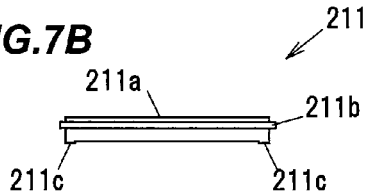
FIG. 7B is a side view showing the first dielectric member.
Figure 7C:
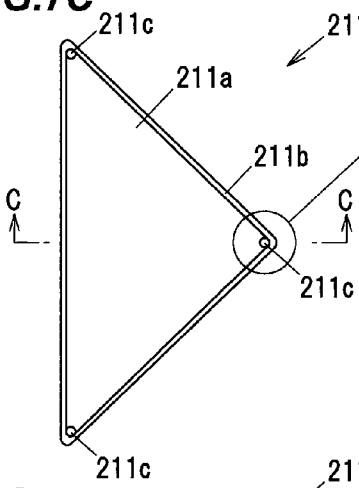
FIG. 7C is a back view showing the first dielectric member.
Figure 7D:
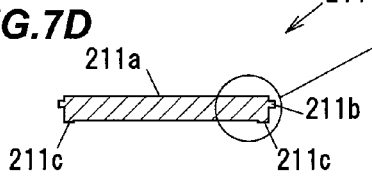
FIG. 7D is a cross sectional view along C-C line in FIG. 7C.
Figure 7E:
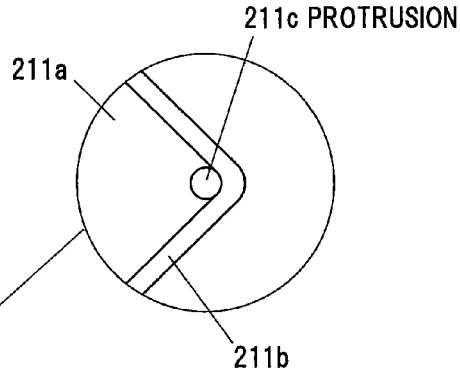
FIG. 7E is a partially enlarged view in FIG. 7C.
Figure 7F:
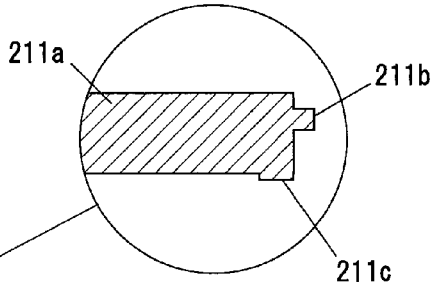
FIG. 7F is a partially enlarged view in FIG. 7D.

FIG. 7A is a front view showing a first dielectric member 211, FIG. 7B is a side view showing the first dielectric member 211, FIG. 7C is a back view showing the first dielectric member 211, FIG. 7D is a cross sectional view along C-C line in FIG. 7C, FIG. 7E is a partially enlarged view in FIG. 7C, and FIG. 7F is a partially enlarged view in FIG. 7D.

Figure 8A:
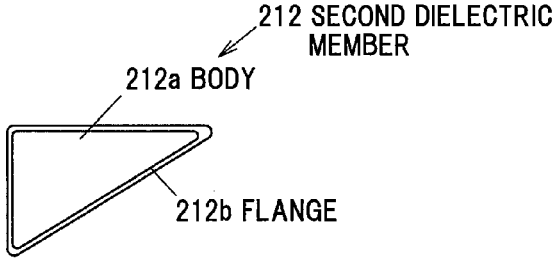
FIG. 8A is a front view showing a second dielectric member.
Figure 8B:
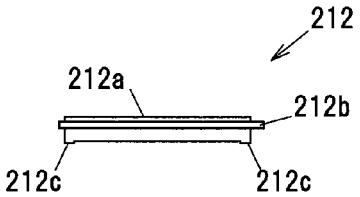
FIG. 8B is a side view showing the second dielectric member.
Figure 8C:
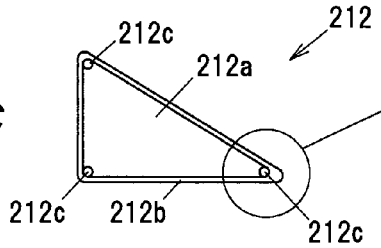
FIG. 8C is a back view showing the second dielectric member.
Figure 8D:
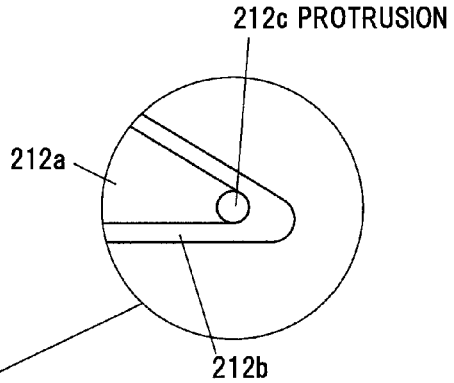
FIG. 8D is a partially enlarged view in FIG. 8C.

FIG. 8A is a front view showing a second dielectric member 212, FIG. 8B is a side view showing the second dielectric member 212, FIG. 8C is a back view showing the second dielectric member 212, and FIG. 8D is a partially enlarged view in FIG. 8C.

Figure 9A:
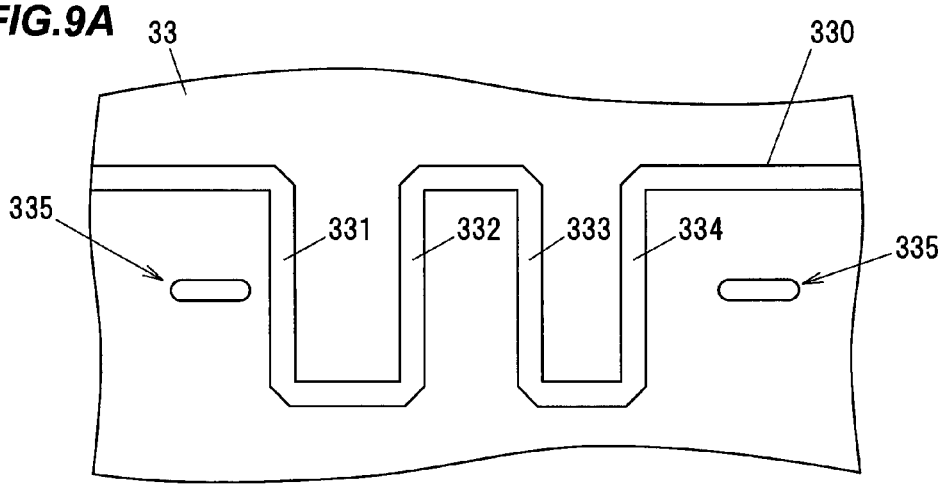
FIG. 9A is a plan view showing the substrate with the signal line on a site where the dielectric assembly for a phase shifter is arranged.
Figure 9B:
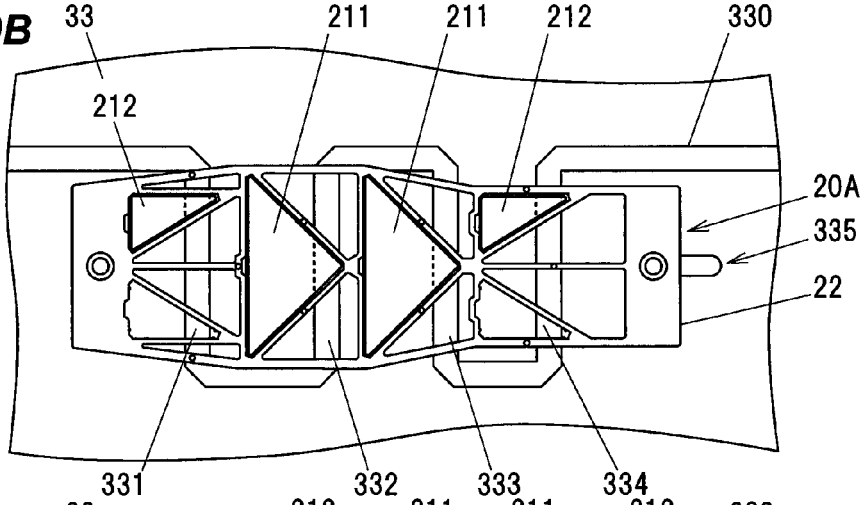
FIG. 9B is an operation explaining diagram showing that the dielectric assembly has been moved to a forward movement end relative to the substrate.
Figure 9C:
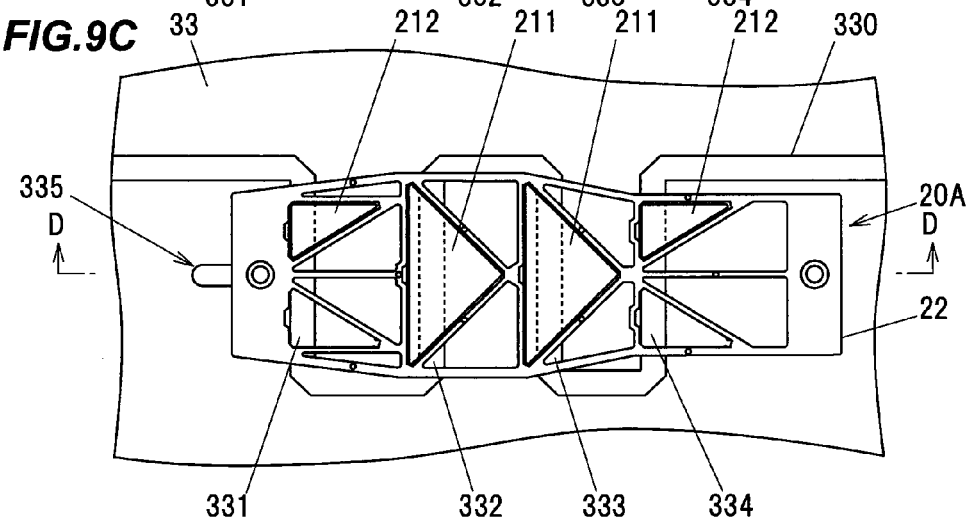
FIG. 9C is an operation explaining diagram showing that the dielectric assembly has been moved to a backward movement end relative to the substrate.

FIG. 9A is a plan view showing the substrate 33 with the signal line 330 on a site where the dielectric assembly 20 of FIGS. 5A-5C for the phase shifter 2 is arranged, FIG. 9B is an operation explaining diagram showing that the dielectric assembly 20 has been moved to a forward movement end relative to the substrate 33, and FIG. 9C is an operation explaining diagram showing that the dielectric assembly 20 has been moved to a backward movement end relative to the substrate 33.

Figure 10A:
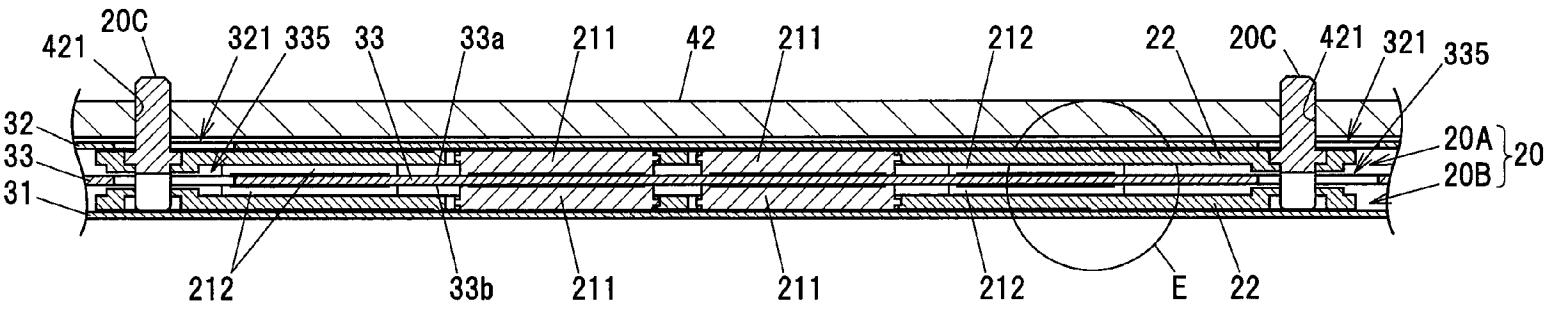
FIG. 10A is a cross sectional view along D-D line in FIG. 9C showing the substrate and the dielectric assembly together with the first and second ground plates and a driving rod.
Figure 10B:
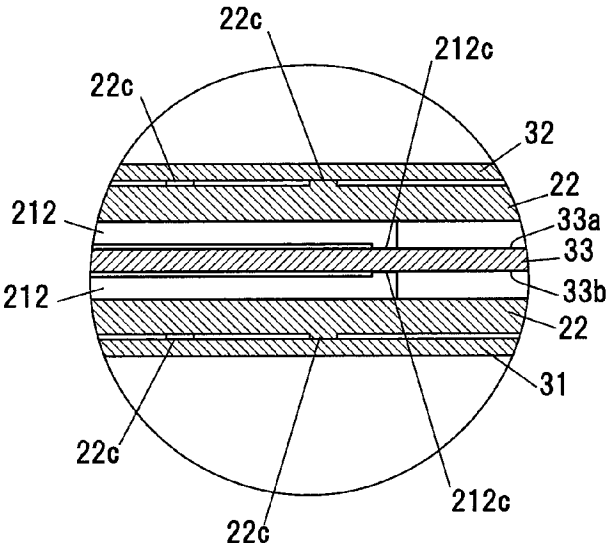
FIG. 10B is an enlarged view showing a portion E in FIG. 10A.

FIG. 10A is a cross sectional view along D-D line in FIG. 9C showing the substrate 33 and the dielectric assembly 20 together with the first and second ground plates 31 and 32 and a driving rod 42. FIG. 10B is an enlarged view showing a portion E in FIG. 10A.

As shown in FIGS. 5A to 5D, the dielectric assembly 20 comprises a first subassembly 20A, which is arranged on a first main surface 33*a* side of the substrate 33 (FIG. 4), a second subassembly 20B, which is arranged on a second main surface 33*b* side of the substrate 33, and a pair of coupling members 20C, which couple the first subassembly 20A and the second subassembly 20B together. As shown in FIGS. 10A and 10B, the first subassembly 20A is arranged between the substrate 33 and the second ground plate 32, while the second subassembly 20B is arranged between the substrate 33 and the first ground plate 31.

Each of the first subassembly 20A and the second subassembly 20B includes a plurality of first dielectric members 211 and a plurality of second dielectric members 212, and a supporting member 22, which supports the plurality of first dielectric members 211 and the plurality of second dielectric members 212. Herein, the first dielectric members 211 and the second dielectric members 212 may collectively be termed "dielectric members 21." That is, the first subassembly 20A and the second subassembly 20B are assemblies, each comprising a plurality of dielectric members 21 assembled to the supporting member 22.

In this embodiment, each of the first subassembly 20A and the second subassembly 20B is composed of four dielectric members 21 (two first dielectric members 211 and two second dielectric members 212) and the supporting member 22, which supports the four dielectric members 21.

(Configuration of the Supporting Member)

As shown in FIG. 6A and FIG. 6C, the supporting member 22 is a flat plate shaped frame body formed with first to fourth supporting frames 221, 222, 223, and 224 and configured to support the two first dielectric members 211 and the two second dielectric members 212, respectively, in the longitudinal direction of the supporting member 22, and the supporting member 22 is formed with a pair of mating holes 225 at both ends, respectively, with the first to fourth supporting frames 221 to 224 therebetween in the longitudinal direction of the supporting member 22, so that the coupling members 20C are mated and fixed to the pair of mating holes 225, respectively.

Also, the supporting member 22 is made of a resin being lower in dielectric constant than the dielectric members 21 and more flexible than the dielectric members 21. As such a resin, e.g. PBT (polybutylene terephthalate) may be adopted.

The supporting member 22 includes a substrate facing surface 22*a* as a substrate 33 side plane and a ground plate facing surface 22*b* as a first ground plate 31 or second ground plate 32 side plane. In the supporting member 22 portions where the first to fourth supporting frames 221 to 224 respectively are formed, the thickness between the substrate facing surface 22*a* and the ground plate facing surface 22*b* is e.g. 1.2 mm.

In this embodiment, a plurality (ten) of protrusions 22*c* (FIGS. 6A, 6B) are formed on the ground plate facing surface 22*b* side of the supporting member 22. As shown in FIG. 10B, the protrusions 22*c* are formed to protrude from the ground plate facing surface 22*b* toward the first ground plate 31 or the second ground plate 32.

The two second dielectric members 212 are supported by the first supporting frame 221 and the fourth supporting frame 224, respectively, formed at one end and the other end, respectively, in the longitudinal direction of the supporting member 22. The two first dielectric members 211 are supported by the second supporting frame 222 and the third supporting frame 223, respectively, formed between the first supporting frame 221 and the fourth supporting frame 224.

In this embodiment, the supporting member 22 includes the two first supporting frames 221 configured to be arranged side by side in its transverse direction and be able to support the second dielectric member 212 at one end in the longitudinal direction of the supporting member 22. At one end in the longitudinal direction of the supporting member 22, the second dielectric member 212 is supported by one of the two first supporting frames 221. Likewise, the supporting member 22 includes the two fourth supporting frames 224 formed to be arranged side by side in its transverse direction and be able to support the second dielectric member 212 at the other end in the longitudinal direction of the supporting member 22. At the other end in the longitudinal direction of the supporting member 22, the second dielectric member 212 is supported by one of the two fourth supporting frames 224.

With the substrate 33 between the second dielectric members 212 of the first subassembly 20A and the second dielectric members 212 of the second subassembly 20B, the second dielectric members 212 are respectively and selectively arranged in one of the two transversely side-by-side arranged first supporting frames 221 of the first subassembly 20A, one of the two transversely side-by-side arranged fourth supporting frames 224 of the first subassembly 20A, one of the two transversely side-by-side arranged first supporting frames 221 of the second subassembly 20B, and one of the two transversely side-by-side arranged fourth supporting frames 224 of the second subassembly 20B.

The supporting member 22 is moved forward or backward parallel to the substrate 33 in its longitudinal direction with the four dielectric members 21 supported by the supporting members 22.

(Configuration of the Signal Line)

As shown in FIG. 9A, the signal line 330 is formed in a meandering shape between the first subassembly 20A and the second subassembly 20B. That is, the signal line 330 includes first to fourth extended portions 331, 332, 333, and 334, which extend at right angles to a direction of movement of the supporting member 22. Also, the substrate 33 includes two elongated holes 335 formed therethrough as inserting holes with the first to fourth extended portions 331 to 334 between those two elongated holes 335 so that the coupling members 20C to couple the first subassembly 20A and the second subassembly 20B together are inserted in those two elongated holes 335, respectively.

The elongated holes 335 extend in a longitudinal direction of the substrate 33, and the first subassembly 20A and the second subassembly 20B are coupled together via the coupling members 20C inserted in those elongated holes 335 respectively.

(Configuration of the First Dielectric Member)

As shown in FIGS. 7A-7D, the first dielectric member 211 (FIGS. 7A-7D) is formed into an isosceles triangular flat plate shape in front view, and is made of a ferroelectric substance having a relative dielectric constant of e.g. not lower than 10. As this ferroelectric substance, e.g. PPS (polyphenylene sulfide) may be used.

The first dielectric members 211 integrally includes a body 211*a* to be opposite the substrate 33 and the signal line 330 (the second extended portion 332 and the third extended portion 333), a flange 211*b*, which is formed at an outer edge of the body 211*a*, and protrusions 211*c*, which are formed in such a manner as to protrude from the body 211*a* toward the substrate 33.

The plate shaped body 211*a* of the first dielectric member 211 is arranged parallel to the substrate 33. The flange 211*b* is formed to project from side surfaces of the body 211*a* and surround an entire perimeter of the body 211*a*. The protrusions 211*c* are formed at three corners, respectively, of the body 211*a*, and are protruded from the body 211*a* surface opposite the substrate 33 and the signal line 330.

(Configuration of the Second Dielectric Member)

As shown in FIGS. 8A-8D, the second dielectric member 212 is formed into a right-angled triangular flat plate shape in front view, and is made of a ferroelectric substance, as with the first dielectric member 211. The second dielectric member 212 is formed smaller in its area opposite the substrate 33 and the signal line 330 than the first dielectric member 211.

The second dielectric member 212 integrally includes a body 212*a* to be opposite the substrate 33 and the signal line 330 (the first extended portions 331 and the fourth extended portions 334), a flange 212*b*, which is formed at an outer edge of the body 212*a*, and protrusions 212*c*, which are formed in such a manner as to protrude from the body 212*a* toward the substrate 33.

The plate shaped body 212*a* of the second dielectric member 212 is arranged parallel to the substrate 33. The flange 212*b* is formed to project from side surfaces of the body 212*a* and surround an entire perimeter of the body 212*a*. The protrusions 212*c* are formed at three corners, respectively, of the body 212*a*, and are protruded from the body 212*a* surface opposite the substrate 33 and the signal line 330.

(Supporting Structure for the First Dielectric Member and the Second Dielectric Member)

As shown in FIGS. 6A-6E, the supporting member 22 includes locking parts 220 configured to lock the respective flanges 211*b* and 212*b* of the first dielectric members 211 and the second dielectric members 212 and support the first dielectric members 211 and the second dielectric members 212. These locking parts 220 are provided for each corner of the first to fourth supporting frames 221 to 224.

A configuration of the locking parts 220 is described by taking the locking part 220 provided at one corner of the third supporting frame 223.

The locking part 220 is composed of two first locking protrusions 220*a* and a second locking protrusion 220*b*, which are formed at different locations, respectively, in a thickness direction of the supporting member 22. In the example shown in FIGS. 6D and 6E, the first locking protrusions 220*a* are formed continuously with the substrate facing surface 22*a* of the supporting member 22, while the second locking protrusion 220*b* is formed continuously with the ground plate facing surface 22*b* of the supporting member 22. The first locking protrusions 220*a* and the second locking protrusion 220*b* are provided inward the third supporting frame 223, with a distance therebetween in the thickness direction of the supporting member 22 corresponding to a thickness of the flange 211*b* of the first dielectric member 211.

Note that although in the example shown in FIGS. 6D and 6E, one locking part 220 is provided with the two first locking protrusions 220*a* and the one second locking protrusion 220*b*, the respective numbers of the first locking protrusions 220*a* and the second locking protrusion 220*b* are not limited thereto, but one locking part 220 may be provided with at least one first locking protrusion 220*a* and at least one second locking protrusion 220*b*.

The locking parts 220 provided for the second supporting frame 222 and the third supporting frame 223 clamp the respective flanges 211*b* of the first dielectric members 211 between their respective first locking protrusions 220*a* and their respective second locking protrusion 220*b*, respectively. Also, the locking parts 220 provided for the first supporting frames 221 and the fourth supporting frames 224 clamp the respective flanges 212*b* of the second dielectric members 212 between their respective first locking protrusions 220*a* and their respective second locking protrusion 220*b*, respectively. When the first dielectric members 211 and the second dielectric members 212 are fixed to the supporting member 22, the supporting member 22 is elastically deformed and each corner of the first dielectric members 211 and the second dielectric members 212 is locked in the locking parts 220. This allows the first dielectric members 211 and the second dielectric members 212 to move integrally with the supporting member 22.

(Operation of the Phase Shifter)

As shown in FIGS. 10A and 10B, the coupling members 20C (FIG. 10A) to couple the first subassembly 20A and the second subassembly 20B together are passed through elongated holes 321 respectively formed through the second ground plate 32 and the elongated holes 335 respectively formed through the substrate 33, and are mated into mating holes 421 respectively provided for the driving rods 42. This allows the dielectric assembly 20 to move along with the driving rods 42, when the linear motor unit 41 of the moving mechanism 4 moves the driving rods 42 in its longitudinal direction. At this point, the supporting members 22 are acted on by a moving force, which moves the dielectric members 21 in such a direction as to be parallel to the substrate 33 and cross the first to fourth extended portions 331 to 334 of the signal line 330. That is, the moving mechanism 4 applies the moving force to the supporting members 22 via the coupling members 20C.

Because the plate shaped bodies 211*a* of the first dielectric members 211 and the plate shaped bodies 212*a* of the second dielectric members 212 are arranged parallel to the substrate 33, the movement of the supporting members 22 acted on by the moving force of the moving mechanism 4 results in variations in areas where the first dielectric members 211 and the second dielectric members 212 overlap the first to fourth extended portions 331 to 334 of the signal line 330, as shown in FIGS. 9B and 9C.

More specifically, as shown in FIG. 9B, when the supporting member 22 is moved to the left side relative to the substrate 33, the overlapping areas where the second dielectric members 212 supported by the first supporting frame 221 and the fourth supporting frame 224 overlap the first and fourth extended portions 331 and 334 decrease, while the overlapping areas where the first supported dielectric members 211 supported by the second supporting frame 222 and the third supporting frame 223 overlap the second and third extended portions 332 and 333 decrease. As shown in FIG. 9C, on the other hand, when the supporting member 22 is moved to the right side relative to the substrate 33, the overlapping areas where the second dielectric members 212 supported by the first supporting frame 221 and the fourth supporting frame 224 overlap the first and fourth extended portions 331 and 334 increase, while the overlapping areas where the first supported dielectric members 211 supported by the second supporting frame 222 and the third supporting frame 223 overlap the second and third extended portions 332 and 333 increase.

Note that the plurality of dielectric assemblies 20 of the transmission line 100 are oriented differently at locations at which they are arranged, respectively.

This varies the proportion of volumes that the first dielectric members 211 and the second dielectric members 212 occupy in the spaces between the signal line 330 and the first and second ground plates 31 and 32, respectively. Thus, a variation in effective permittivities of the first to fourth extended portions 331 to 334 of the triplate line composed of the signal line 330 and the first and second ground plates 31 and 32 occurs, resulting in a variation in electrical line length and therefore a variation in phase of the signal propagating in the signal line 330.

Here, if there is a variation in the distances (in the thickness direction of the substrate 33) between the signal line 330 and the respective bodies 211*a* and 212*a* of the first dielectric members 211 and the second dielectric members 212, even when the moving mechanism 4 is not actuated, a variation in effective permittivities of the first to fourth extended portions 331 to 334 occurs, resulting in a variation in electrical line length. In view of this, in the present embodiment, movements (displacements) in the thickness direction of the substrate 33 of the first dielectric members 211 and the second dielectric members 212 are suppressed by the protrusions 211*c* and 212*c* of the first dielectric members 211 and the second dielectric members 212, and the protrusions 22*c* of the supporting members 22.

Next, a supporting structure for the first dielectric members 211 and the second dielectric members 212 between the signal line 330 and the first and second ground plates 31 and 32 is described.

(Supporting Structure for the First Dielectric Member and the Second Dielectric Member)

The protrusions 211*c* and 212*c* of the first dielectric members 211 and the second dielectric members 212, respectively are brought into contact with the substrate 33 or the signal line 330 at their tip surfaces, to regulate movement in a direction closer to the substrate 33 of the respective bodies 211*a* and 212*a* of the first dielectric members 211 and the second dielectric members 212. Also, the protrusions 22*c* of the supporting members 22 are brought into contact with the first ground plate 31 or the second ground plate 32 at their tip surfaces, to regulate movement in a direction away from the substrate 33 of the respective bodies 211*a* and 212*a* of the first dielectric members 211 and the second dielectric members 212.

That is, in the present embodiment, the first dielectric members 211 and the second dielectric members 212 are provided with their respective protrusions 211*c* and 212*c* to keep a distance (i.e. hold a space) between the respective bodies 211*a* and 212*a* of the first dielectric members 211 and the second dielectric members 212 and the signal line 330, while the supporting members 22 are provided with their respective protrusions 22*c* to keep a distance between the respective bodies 211*a* and 212*a* of the first dielectric members 211 and the second dielectric members 212 and the first and second ground plates 31 and 32.

It should be noted, however, that the first dielectric members 211 and the second dielectric members 212 may also be provided with their respective protrusions to keep a distance between their respective bodies 211*a* and 212*a* and the first and second ground plates 31 and 32. Also, the supporting members 22 may be provided with their respective protrusions to keep a distance between the respective bodies 211*a* and 212*a* of the first dielectric members 211 and the second dielectric members 212 and the signal line 330. That is, either the dielectric members 21 (the first dielectric members 211 and the second dielectric members 212) or the supporting members 22 may be provided with their respective protrusions to hold a space between the respective bodies 211*a* and 212*a* of the first dielectric members 211 and the second dielectric members 212 and the signal line 330, and either the dielectric members 21 or the supporting members 22 may also be provided with their respective protrusions to hold a space between the respective bodies 211*a* and 212*a* of the first dielectric members 211 and the second dielectric members 212 and the first and second ground plates 31 and 32.

Note that in the present embodiment, only the first dielectric members 211 and the second dielectric members 212 are provided with their respective protrusions (protrusions 211*c* and 212*c*) to hold a space between the respective bodies 211*a* and 212*a* of the first dielectric members 211 and the second dielectric members 212 and the signal line 330, and only the supporting members 22 are provided with their respective protrusions (protrusions 22*c*) to keep a distance (a space) between the respective bodies 211*a* and 212*a* of the first dielectric members 211 and the second dielectric members 212 and the first and second ground plates 31 and 32, so that, for example, even if the space between the substrate 33 and the first and second ground plates 31 and 32 do not conform to a design value due to distortion, etc. of the first and second ground plates 31 and 32, this error can be canceled out by elastic deformation of the locking parts 220 of the supporting members 22. That is, the protrusions 211*c* and 212*c* of the first dielectric members 211 and the second dielectric members 212 or the protrusions 22*c* of the supporting members 22 can be prevented from being stuck between the substrate 33 and the first and second ground plates 31 and 32, and the dielectric assembly 20 can therefore smoothly be moved.

Also, in the present embodiment, the protrusions 211*c* and 212*c* of the first dielectric members 211 and the second dielectric members 212 ensure the more space between the signal line 330 and the bodies 211*a* and 212*a* than the protruding length of those protrusions 211*c* and 212*c*. That is, the first dielectric members 211 and the second dielectric members 212 are not in close contact with the signal line 330. This allows for suppressing the variations in the effective permittivities of the first to fourth extended portions 331 to 334 of the signal line 330, thereby stabilizing the amount of phase shift due to the phase shifter 2.

That is, the variation widths of the effective permittivities of the first to fourth extended portions 331 to 334 are significant especially when the space between the respective bodies 211*a* and 212*a* of the first dielectric members 211 and the second dielectric members 212 and the signal line 330 is narrow. According to experiments carried out by the inventors, when the dielectric assembly 20 lies at a neutral location (an intermediate location between the location shown in FIG. 9B and the location shown in FIG. 9C), the amount of phase shift (the amount of phase change) at the time the space between the respective bodies 211*a* and 212*a* of the first dielectric members 211 and the second dielectric members 212 and the signal line 330 is varied from 0.00 mm to 0.02 mm is approximately 2.91 times the amount of phase shift at the time that space is varied from 0.08 mm to 0.10 mm.

That is, in the present embodiment, because the protrusions 211*c* and 212*c* prevent the respective bodies 211*a* and 212*a* of the first dielectric members 211 and the second dielectric members 212 from being in close contact with the signal line 330, the space between the respective bodies 211*a* and 212*a* of the first dielectric members 211 and the second dielectric members 212 and the signal line 330 is held not less than a specified value, and the amount of phase shift is stabilized.

The protruding length of the protrusions 211*c* and 212*c* from the bodies 211*a* and 212*a*, i.e. the space between the signal line 330 and the respective bodies 211*a* and 212*a* of the first dielectric members 211 and the second dielectric members 212 in the first to fourth extended portions 331 to 334 is desirably 0.1 to 0.2 mm (not less than 0.1 mm and not more than 0.2 mm). It is because if that space is less than 0.1 mm, the variation width of the amount of phase shift when the first dielectric members 211 and the second dielectric members 212 are brought closer to or away from the substrate 33 is large, while if that space exceeds 0.2 mm, the phase adjustment width of the phase shifter 2 is small. Note that, also for the protrusions 22*c* of the supporting member 22, their protruding length from the ground plate facing surface 22*b* is desirably 0.1 to 0.2 mm.

Operation and Advantageous Effects of the Embodiment

The above described embodiment has the following operation and advantageous effects.

(1) Since the first dielectric members 211 and the second dielectric members 212 are provided with their respective protrusions 211*c* and 212*c* to hold a space between their respective bodies 211*a* and 212*a* and the signal line 330, the first dielectric members 211 and the second dielectric members 212 are not in close contact with the signal line 330, and the variation in that space is suppressed. This makes it possible to suppress the unintended variations in the amount of phase shift and adjust the directivity of the antenna device 1 with high precision.

(2) Since the supporting members 22 are provided with their respective protrusions 22*c* to regulate movement in a direction away from the substrate 33 of the first dielectric members 211 and the second dielectric members 212 and hold a space between the respective bodies 211*a* and 212*a* of the first dielectric members 211 and the second dielectric members 212 and the first and second ground plates 31 and 32, it is possible to suppress the unintended variations in the amount of phase shift and adjust the directivity of the antenna device 1 with high precision.

(3) Since the first dielectric members 211 and the second dielectric members 212 are provided with their respective protrusions 211*c* and 212*c* to keep a distance (hold a space) between their respective bodies 211*a* and 212*a* and the signal line 330, the distance (the space) between the respective bodies 211*a* and 212*a* of the first dielectric members 211 and the second dielectric members 212 and the signal line 330 is more securely held not less than a specified value, in comparison to when that distance (space) is held by protrusions provided for the supporting members 22.

(4) Since the signal line 330 is formed symmetrically on the first main surface 33*a* and the second main surface 33*b*, and the first subassembly 20A and the second subassembly 20B are arranged on the first main surface 33*a* side and the second main surface 33*b* side respectively, it is possible to increase the phase adjustment width of the phase shifter 2. Also, since the first subassembly 20A and the second subassembly 20B are coupled together by the coupling members 20C inserted in the elongated holes 335 respectively formed through the substrate 33, it is possible to move the first subassembly 20A and the second subassembly 20B together by the actuation of the moving mechanism 4.

(Summary of the Embodiment)

Next, the technical concept that is ascertained from the embodiment described above will be described with the aid of the reference characters and the like in the embodiment. It should be noted, however, that each of the reference characters in the following description should not be construed as limiting the constituent elements in the claims to the members and the like specifically shown in the embodiment.

[1] A phase shifter, comprising:

dielectric members (21) including facing portions (bodies 211*a* and 212*a*) facing a signal line (330) formed on a surface of a substrate (33) and comprising a dielectric material;

a supporting member (22) configured to support the dielectric members (21) and receive a moving force for moving the dielectric members (21) in a direction which is parallel to the substrate (33) and crosses the signal line (330); and a moving mechanism (4) configured to apply the moving force to the supporting member (22), wherein at least either the dielectric members (21) or the supporting member (22) is provided with a protrusion (211*c* and 212*c*) to keep a distance between the facing portions (211*a* and 212*a*) of the dielectric members (21) and the signal line (330).

[2] The phase shifter according to [1], wherein the dielectric members (21) are arranged between the substrate (33) and conductor plates (first and second ground plates 31 and 32) respectively arranged parallel to the substrate (33), and at least either the dielectric members (21) or the supporting member (22) is provided with a protrusion (22*c*) to keep a distance between the respective facing portions (211*a* and 212*a*) of the dielectric members (21) and the conductor plates (31 and 32).

[3] The phase shifter according to [1] or [2], wherein the protrusion (211*c* and 212*c*) to keep the distance between the facing portions (211*a* and 212*a*) of the dielectric members (21) and the signal line (330) is formed on the dielectric members (21).

[4] The phase shifter according to any one of [1] to [3], wherein the signal line (330) is formed on both main surfaces (33*a* and 33*b*) of the substrate (33), and assemblies (20A and 20B) each comprising the dielectric members (21) assembled to the supporting member (22) are arranged on one main surface (33*a*) side of the substrate (33) and an other main surface (33*b*) side of the substrate (33) respectively, and the assembly (20A) arranged on the one main surface (33*a*) side and the assembly (20B) arranged on the other main surface (33*b*) side are coupled together via a coupling member (20C) inserted in an inserting hole (335) formed through the substrate (33).

[5] An antenna device (1), comprising:

the phase shifter according to any one of [1] to [4]; and antenna elements (14), wherein a signal phase difference between the antenna elements is adjusted by the phase shifter.

Although the embodiment of the present invention has been described above, the embodiment described above should not be construed as limiting the invention in the appended claims. It should also be noted that not all the combinations of the features described in the above embodiment are essential to the means for solving the problems of the invention.

What is claimed is:

1. A phase shifter, comprising:

dielectric members including facing portions facing a signal line formed on a surface of a substrate and comprising a dielectric material, the dielectric members being arranged between the substrate and conductor plates respectively arranged parallel to the substrate;

a supporting member comprising a flat plate shaped frame body formed with supporting frames into which the dielectric members are inserted and configured to support the dielectric members and receive a moving force for moving the dielectric members in a direction which is parallel to the substrate and crosses the signal line; and a moving mechanism configured to apply the moving force to the supporting member, wherein the dielectric members are formed with a first protrusion potruding toward the substrate, and the first protrusion is brought in contact with the substrate or the signal line to keep a distance between the facing portions of the dielectric members and the signal line, and wherein a distance between the facing portions of the dielectric members and the conductor plates is kept by a contact between the supporting member formed with the supporting frames and the conductor plates.

2. The phase shifter according to claim 1, wherein the supporting member comprises a resin having a lower dielectric constant than a dielectric constant of the dielectric members.

3. The phase shifter according to claim 2, wherein the resin comprises polybutylene terephthalate (PBT).

4. The phase shifter according to claim 1, wherein the signal line is formed on both main surfaces of the substrate including the surface of the substrate, and assemblies each comprising the dielectric members assembled to the supporting member are arranged on one main surface side of the substrate and an other main surface side of the substrate respectively, and the assembly arranged on the one main surface side and the assembly arranged on the other main surface side are coupled together via a coupling member inserted in an inserting hole formed through the substrate.

5. An antenna device, comprising:

the phase shifter according to claim 1; and antenna elements, wherein a signal phase difference between the antenna elements is adjusted by the phase shifter by setting a beam tilt angle of radio waves radiated from the antenna device.

6. The phase shifter according to claim 1, wherein a distance between the facing portions of the dielectric members and the conductor plates is kept by a contact between a second protrusion formed at the supporting member and the conductor plates.

7. The phase shifter according to claim 1, wherein the dielectric members include flanges respectively, and the supporting member includes locking parts configured to lock the flanges thereby supporting the supporting member.

8. The phase shifter according to claim 1, wherein the dielectric members include first dielectric members each of which is formed into an isosceles triangular flat plate shape in a front view and second dielectric members each of which is formed into a right-angled triangular flat plate shape in the front view.

9. The phase shifter according to claim 8, wherein the first dielectric members include a body located opposite to the substrate and the signal line, a flange disposed on an outer edge of the body, and projections protruding from the body toward the substrate.

10. The phase shifter according to claim 9, wherein the body of the first dielectric member is arranged parallel to the substrate.

11. The phase shifter according to claim 9, wherein the flange is formed to project from side surfaces of the body and surround an entire perimeter of the body.

12. The phase shifter according to claim 9, wherein the projections are formed at corners of the body and are protruded from a surface of the body opposite to the substrate and the signal line.

13. The phase shifter according to claim 8, wherein the first dielectric members comprise a ferroelectric substance.

14. The phase shifter according to claim 8, wherein the supporting member comprises a flat plate shaped frame body including a plurality of supporting frames configured to support the first dielectric members and the second dielectric members in a longitudinal direction of the supporting member.

15. The phase shifter according to claim 14, wherein the supporting member is formed with a pair of mating holes at both ends, respectively, with the plurality of supporting frames therebetween in the longitudinal direction of the supporting member.

16. The phase shifter according to claim 15, further comprising coupling members that are mated and attached to the pair of mating holes.

17. The phase shifter according to claim 1, wherein the signal line comprises a metal foil provided as a wiring pattern on the surface of the substrate.

18. The phase shifter according to claim 1, wherein the signal line is further fowled on another surface of the substrate symmetrically as formed on the surface of the substrate.

* * * * *